US009008547B2

(12) United States Patent
Takano

(10) Patent No.: US 9,008,547 B2
(45) Date of Patent: Apr. 14, 2015

(54) MOVING DEVICE AND IMAGE FORMING APPARATUS INCLUDING THE MOVING DEVICE

(71) Applicant: Kuniyori Takano, Kanagawa (JP)

(72) Inventor: Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 45 days.

(21) Appl. No.: 13/855,836

(22) Filed: Apr. 3, 2013

(65) Prior Publication Data

US 2013/0308983 A1 Nov. 21, 2013

(30) Foreign Application Priority Data

May 21, 2012 (JP) ..... 2012-116016
Oct. 26, 2012 (JP) ..... 2012-237299

(51) Int. Cl.
*G03G 15/04* (2006.01)
*G03G 15/00* (2006.01)
*G03G 21/16* (2006.01)

(52) U.S. Cl.
CPC ..... *G03G 15/04* (2013.01); *G03G 15/757* (2013.01); *G03G 21/1647* (2013.01); *G03G 21/1666* (2013.01)

(58) Field of Classification Search
USPC ..... 399/118
See application file for complete search history.

(56) References Cited

U.S. PATENT DOCUMENTS 5,291,249 A * 3/1994 Lee ..... 399/113
8,428,489 B2 * 4/2013 Sameshima et al. ..... 399/110
8,755,715 B2 * 6/2014 Mori et al. ..... 399/112
2012/0070189 A1 * 3/2012 Okabe ..... 399/111
2012/0155916 A1 * 6/2012 Ito et al. ..... 399/110

FOREIGN PATENT DOCUMENTS

| | | |
|---|---|---|
| JP | 4-069674 | 3/1992 |
| JP | 5-107840 | 4/1993 |
| JP | 5-249767 | 9/1993 |
| JP | 2001-175046 | 6/2001 |
| JP | 2006-018127 | 1/2006 |
| JP | 2006-018128 | 1/2006 |
| JP | 2006-058454 | 3/2006 |
| JP | 2006-163027 | 6/2006 |
| JP | 2010-256920 | 11/2010 |

* cited by examiner

*Primary Examiner* — Billy Lactaoen
*Assistant Examiner* — Arlene Heredia Ocasio
(74) *Attorney, Agent, or Firm* — Harness, Dickey & Pierce, P.L.C.

(57) ABSTRACT

A moving device includes a rotary member rotatably supported by a frame of the image forming apparatus to move a latent image forming device between a first position at which the latent image forming device forms a latent image on a latent image bearing member and a second position at which the latent image forming device is separated from the latent image bearing member, a biasing member for biasing the rotary member, and a restriction member for restricting rotation of the rotary member in a state in which the latent image forming device is at the first position. A direction of the force of the biasing member is changed from a stopping direction in which rotation of the rotary member is stopped to a direction opposite the stopping direction while the rotary member is rotated to move the latent image forming device from the second position to the first position.

20 Claims, 8 Drawing Sheets

MOVING DEVICE AND IMAGE FORMING APPARATUS INCLUDING THE MOVING DEVICE

CROSS-REFERENCE TO RELATED APPLICATIONS

This patent application is based on and claims priority pursuant to 35 U.S.C. §119 from Japanese Patent Application Nos. 2012-116016, filed on May 21, 2012, and 2012-237299, filed on Oct. 26, 2012, both in the Japan Patent Office, which are hereby incorporated herein by reference in their entirety.

BACKGROUND

1. Technical Field

Exemplary aspects of the present invention generally relate to a moving device and an image forming apparatus including the moving device.

2. Related Art

Conventionally, known image forming apparatuses employ an optical writing head including a plurality of light emitting elements arranged in an axial direction of a photosensitive member on which a latent image is formed.

Image forming apparatuses of this kind include a type equipped with a moving device that moves the optical writing head between an engaged position at which the optical writing head writes the latent image on the surface of the photosensitive member and a retracted position. FIG. 9 is a schematic diagram illustrating such a moving device 250, located near a writing head 231. FIG. 10 is a top view of the moving device 250 shown in FIG. 9.

The writing head 231 shown in FIG. 9 is held by a holder 233. The holder 233 includes a guide rod 236 that penetrates through a frame 240 of the image forming apparatus. A spring seat 242 is provided to an end of the guide rod 236, and a compression spring 243 is disposed between the spring seat 242 and the frame 240.

As illustrated in FIGS. 9 and 10, the moving device 250 includes a pair of pressing levers 245, a lever 248, an arm 251, a rib 262, and so forth. The pair of pressing levers 245 is fixed to a shaft 246 at a predetermined interval. The shaft 246 is rotatably supported by a pair of brackets 247 disposed on the upper surface of the frame 240. The lever 248 is fixed substantially at the center of the shaft 246. One end of a wire 249 is connected to the lever 248. The other end of the wire 249 is fixed to an end of the arm 251, which is swingably attached to the front side (the lower side in FIG. 10) of the frame 240. The other end of the arm 251 is biased by a coil spring 249B in the direction indicated by an arrow D. The rib 262 is disposed on the inner surface of an openably closable front cover 260. The front cover 260 is attached to the front side of the frame by a hinge 261.

With the front cover 260 closed, the rib 262 presses the end of the arm 251 in the direction indicated by an arrow A while the pair of the pressing levers 245 presses the spring seat 242 against the compression spring 243, thereby pressing the holder 233 against a photosensitive member 211. With this configuration, the writing head 231 is positioned at the engaged position.

Upon replacement of the photosensitive drum 211, the front cover 260 is opened, moving the rib 262 in the opposite direction of the direction of arrow A in FIG. 10. Subsequently, the coil spring 249B and the compression spring 243 cause the arm 251 to rotate in the direction of arrow B in FIG. 10, and the wire 249 moves in the direction of arrow C. As the wire 249 moves in the direction of arrow C, the shaft 246 rotates in the direction of arrow E, thereby rotating the pressing levers 245 in the direction of arrow G in FIG. 9. With this configuration, the holder 233 is moved in the direction of arrow H by the compression spring 243, thereby moving the writing head 231 from the engaged position to a retracted position at which the writing head 231 is separated from the photosensitive member 211.

As the front cover 260 is completely opened, the pressing lever 245 is separated from the spring seat 242 as indicated by a broken line in FIG. 9. As a result, the compression spring 243 obtains its free length, thereby moving the writing head 231 with the holder 233 to the retracted position indicated by the broken line.

In the configuration described above, when the writing head 231 is at the retracted position, the pressing levers 245 are biased by the coil spring 249B and the compression spring 243 in the direction corresponding to the direction in which the writing head 231 is moved from the engaged position to the retracted position. Accordingly, even when the image forming apparatus receives some stress upon replacement of the photosensitive member, a developing device, and so forth, the writing head 231 does not easily move from the retracted position to the engaged position.

The rib 262 restricts rotation of the arm 251 to position the writing head 231 at the engaged position. Although advantageous, because the rib 262 is disposed on the front cover 260, which is opened and closed relative to the frame of the image forming apparatus, the restriction position of the arm 251 varies, and it is difficult to reliably position the writing head 231 at the engaged position with precision. As a result, a high-resolution latent image is not formed on the surface of the photosensitive member.

SUMMARY

In view of the foregoing, in an aspect of this disclosure, there is provided an improved moving device for moving a latent image forming device employed in an image forming apparatus between a first position at which the latent image forming device forms a latent image on a surface of a latent image bearing member and a second position at which the latent image forming device is separated from the latent image bearing member. The moving device includes a rotary member, a biasing member, and a restriction member. The rotary member is rotatably supported by a frame of the image forming apparatus to move the latent image forming device between the first position and the second position. The biasing member biases the rotary member. The restriction member restricts rotation of the rotary member biased by the biasing member in a state in which the latent image forming device is at the first position. A direction of the force of the biasing member is changed from a stopping direction in which rotation of the rotary member is stopped to a direction opposite to the stopping direction while the rotary member is rotated to move the latent image forming device from the second position to the first position. This configuration prevents the latent image forming device from moving from the second position to the first position upon replacement of the latent image bearing member and so forth while positioning reliably the latent image forming device at the first position.

The aforementioned and other aspects, features, and advantages would be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
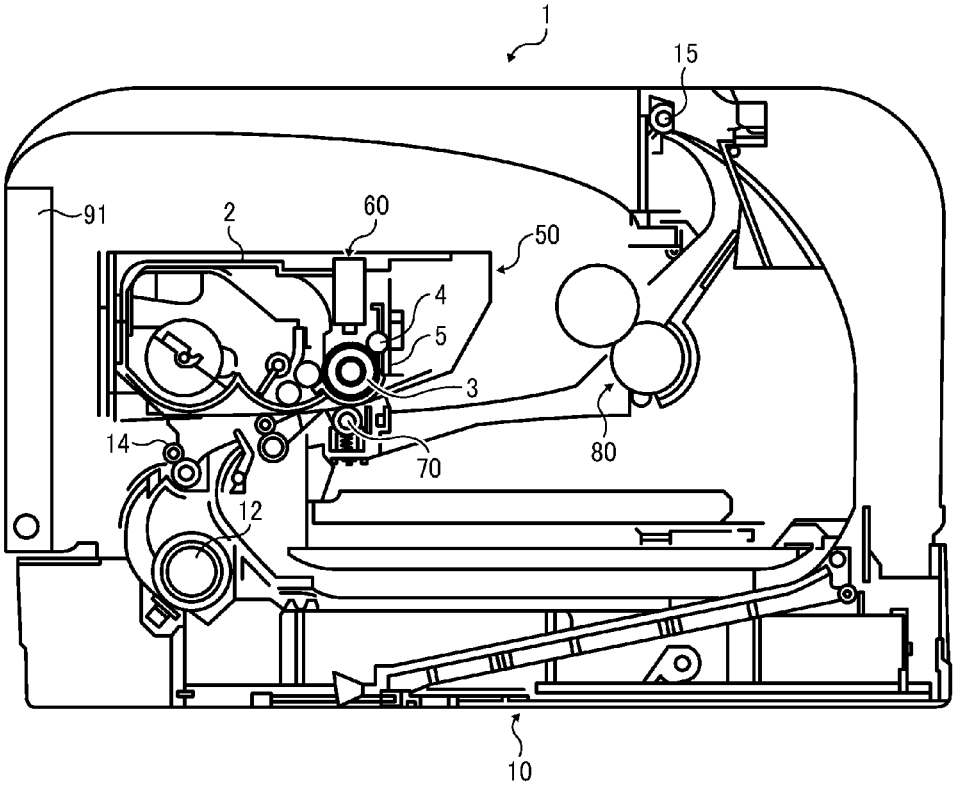
FIG. 1 is a schematic diagram illustrating a printer as an example of an image forming apparatus, according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a laser printer as an example of an image forming apparatus 1 according to an illustrative embodiment of the present invention. As illustrated in FIG. 1, the image forming apparatus 1 includes a process cartridge 50 detachably attachable relative to the image forming apparatus 1, an exposure device 60 serving as a latent image forming device, a transfer device including a transfer roller 70, a developing device 2, a sheet cassette 10, a fixing device 80, and so forth.

As illustrated in FIG. 1, the process cartridge 50 includes a photosensitive drum 3 serving as a latent image bearing member, a charging roller 4 serving as a charger, a developing device 2, a cleaning device 5, and so forth.

While the photosensitive drum 3 is rotated in a counter-clockwise direction, the surface thereof is charged uniformly by the charging roller 4. After the surface is charged, the photosensitive drum 3 is illuminated with light by the exposure device 60 based on image information, thereby forming an electrostatic latent image on the surface of the photosensitive drum 3. The electrostatic latent image on the photosensitive drum 3 is developed with toner by the developing device 2 into a visible image, known as a toner image. The toner image formed on the photosensitive drum 3 is transferred onto a recording medium by the transfer roller 70 of a transfer unit. The recording medium stored in the sheet cassette 10 is fed to the transfer roller 70 via a sheet feed roller 12 and a pair of registration rollers 14.

After transfer process, the recording medium bearing an unfixed toner image is delivered to the fixing device 80 by which the unfixed toner image is fixed to the recording medium. Subsequently, the recording medium is output to a sheet output tray outside the image forming apparatus by a sheet output roller 15. Residual toner, not having been transferred, thus remaining on the photosensitive drum 3 is removed by the cleaning device 5. A charge eraser removes residual potential on the surface of the photosensitive drum 3.

Due to degradation of the photosensitive drum 3 and the developing device 2 with time, the process cartridge 50 may need to be replaced. In such a case, the process cartridge 50 is taken out from the image forming apparatus 1 by opening a cover 91 of the image forming apparatus frame. The cover 91 is provided to the left side of the image forming apparatus 1. According to the present illustrative embodiment, the photosensitive drum 3 and the developing device 2 are held together as a single integrated unit constituting the process cartridge 50. Alternatively, the photosensitive drum 3 and the developing device 2 may be detachably attachable independently.

Figure 2:
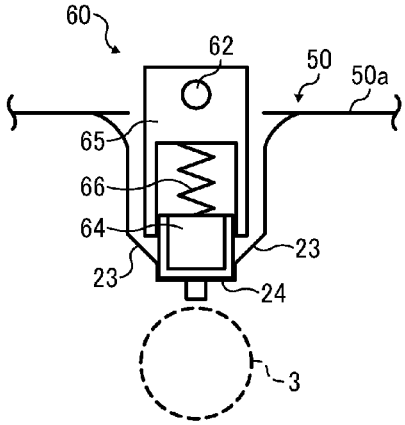
FIG. 2 is a schematic diagram illustrating an exposure device employed in the image forming apparatus of FIG. 1 and devices near the exposure device.

Referring now to FIG. 2, a description is provided of the exposure device 60 according to the illustrative embodiment. FIG. 2 is a schematic diagram illustrating the exposure device 60 and devices near the exposure device 60.

As illustrated in FIG. 2, the exposure device 60 includes a writing head 64 and a holder 65 that holds the writing head 64. The writing head 64 includes a plurality of light emitting elements such as LEDs and organic EL devices arranged in the longitudinal direction of the photosensitive drum 3, and a plurality of lenses aligned to correspond to the photosensitive drum 3 and the light emitting elements. The writing head 64 held by the holder 65 is pressed by a spring 66 towards the photosensitive drum 3. Based on image information, the light emitting elements at a predetermined position in the writing head 64 illuminate the photosensitive drum 3 with light, thereby forming an electrostatic latent image on the surface of the photosensitive drum 3.

Each portion of the holder 65 in the longitudinal direction includes a projection 62 which is supported by a moving device described later.

The process cartridge 50 includes a housing 50*a* provided with a positioning member 24 which positions the exposure device 60 at a first position which corresponds to an engaged position at which the writing head engages in writing a latent image. By contacting the positioning member 24, the exposure device 60 is positioned at the first position a certain distance from the photosensitive drum 3, thereby forming a desired latent image.

The housing 50*a* includes a guide member 23 that guides the exposure device 60 to the positioning member 24. As will be described later, when the exposure device 60 moves from a second position or a retracted position separated from the photosensitive drum 3 to the first position, the exposure device 60 is guided to the positioning member 24 by the guide member 23 and contacts the positioning member 24. Accordingly, the exposure device 60 is positioned at the first position.

The writing head 64 has a short focal length so that the exposure device 60 needs to be positioned near the photosensitive drum 3. The drawback of disposing the exposure device 60 near the photosensitive drum 3 is that the exposure device 60 hinders replacement and installation of the process cartridge 50. In view of the above, according to the illustrative embodiment, the exposure device 60 is movable between the first position near the photosensitive drum 3 and the second position separated from the photosensitive drum 3.

Figure 3:
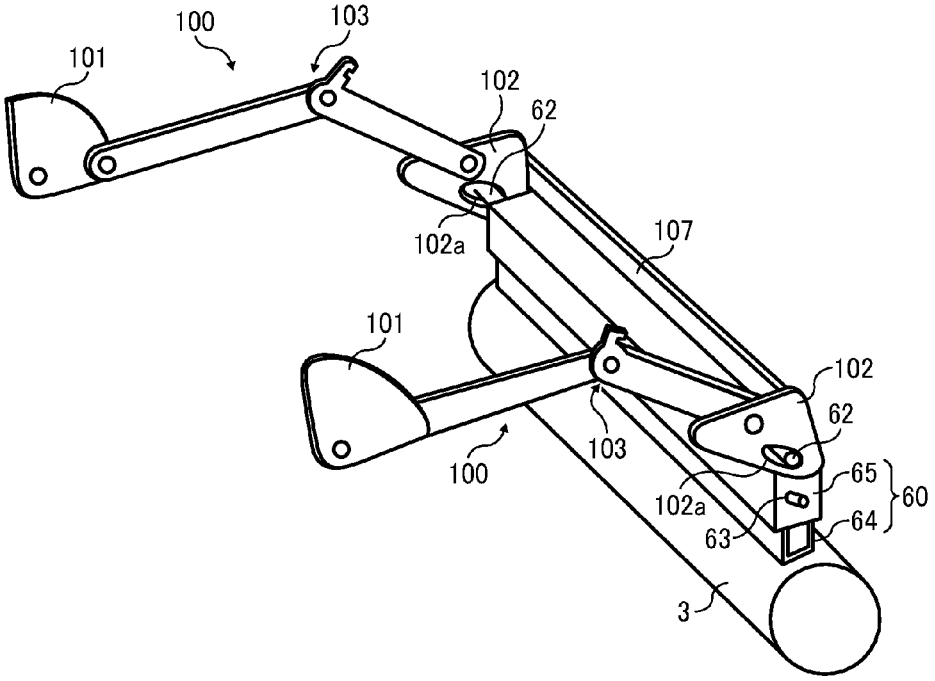
FIG. 3 is a perspective view illustrating a moving device, the exposure device, and a photosensitive drum according to an illustrative embodiment of the present invention.
Figure 4:
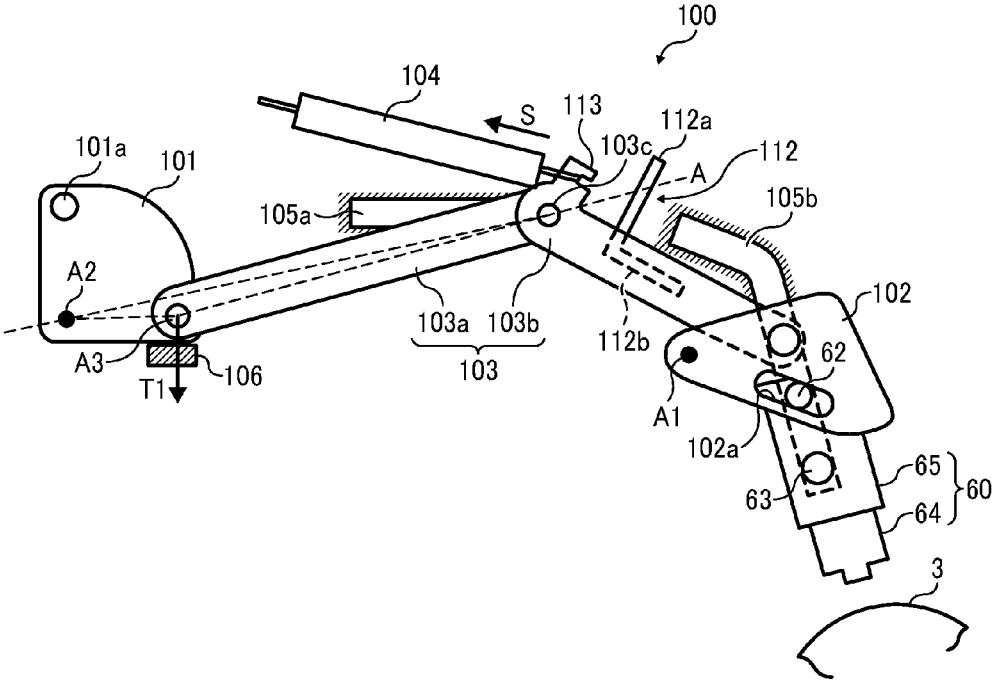
FIG. 4 is a schematic diagram illustrating the moving device according to an illustrative embodiment of the present invention.

With reference to FIGS. 3 and 4, a description is provided of a moving device 100 according to an illustrative embodiment of the present invention. FIG. 3 is a perspective view schematically illustrating the moving device 100, the exposure device 60, and the photosensitive drum 3 according to an illustrative embodiment of the present invention. FIG. 4 is a schematic diagram illustrating one side of the moving device 100. FIGS. 3 and 4 illustrate the exposure device 60 at the first position at which the exposure device 60 forms a latent image on the photosensitive drum 3.

As illustrated in FIG. 3, the moving device 100 is provided to each end of the exposure device 60 in the longitudinal direction thereof.

As illustrated in FIG. 4, the moving device 100 includes a first link member 101, a second link member 102, a connector 103 to connect the first link member 101 and the second link member 102. The first link member 101 is rotatably supported by the frame of the image forming apparatus 1. The second link member 102 serves as a holder to hold the exposure device 60 and is rotatably supported by the frame of the image forming apparatus 1.

As illustrated in FIG. 4, the connector 103 includes a first arm 103*a* serving as a first connecting member and a second arm serving as a second connecting member 103*b*. One end of the first arm 103*a* is rotatably supported by the first link member 101, and the opposite end thereof is rotatably supported by a connecting shaft 103*c*. One end of the second arm 103*b* is rotatably supported by the connecting shaft 103*c*, and the opposite end thereof is rotatably supported by the second link member 102. The connecting shaft 103*c* penetrates through a first opening or slot 105*a* which extends to the cover 91 (left side in FIG. 4) provided to a lateral plate of the frame of the image forming apparatus 1.

The second link member 102 includes a slot or elongate hole 102*a* extending towards a fulcrum A1 of the second link member 102. The projection 62 at each end of the holder 65 of the exposure device 60 penetrates through the slot 102*a*. As the projections 62 at both ends of the exposure device 60 penetrate through the slots 102*a*, the exposure device 60 is supported by the moving device 100. Furthermore, as illustrated in FIG. 4, the projection 62 penetrates through a second opening or slot 105*b* serving as a connector guide provided to the lateral plate of the frame. The holder 65 of the exposure device 60 includes a guide projection 63 which also penetrates through the second opening or slot 105*b*.

The first link member 101 is in the shape of a substantially circular sector with a central angle of approximately 90 degrees. The first arm 103*a* is rotatably supported by an end of the first link member 101 in the circumferential direction thereof. A boss 101*a* serving also as a first contact portion is provided to the other end of the first link member 101 in the circumferential direction.

An end of the second arm 103*b* (i.e., a rotatably-supported side of the second arm 103*b* by the connecting shaft 103*c*) includes a notch 113 to which an end of a tension spring 104 serving as a biasing member is hooked. One end of the tension spring 104 is hooked to the notch 113, thereby biasing the second arm 103*b* in the direction of arrow S.

The tension of the tension spring 104 causes the connecting shaft 103*c* to move towards the first link member 101. At this time, a support position A3 of the first arm 103*a* supported by the first link member 101 is lower than a line A connecting a fulcrum A2 of the first link member 101 to the connecting shaft 103*c*. As a result, the connecting shaft 103*c* moving towards the first link member 101 generates a force that moves the support position A3 to move in the direction of arrow T1, which then generates a force that rotatably moves the first link member 101 in the clockwise direction. Accordingly, the first link member 101 comes into contact with a restriction member 106 provided to the frame of the image forming apparatus.

According to the present illustrative embodiment, the first link member 101 is biased in the clockwise direction by the tension spring 104 via the connector 103, thereby causing the first link member 101 to contact the restriction member 106 and thus moving the exposure device 60 to the first position or the engaged position.

According to the present illustrative embodiment, as illustrated in FIG. 3, the moving device 100 is provided to each end of the exposure device 60. Alternatively, the moving device 100 may be provided to only one end of the exposure device 60, which reduces the number of parts and the overall cost. In a case in which the moving device 100 is provided only to one end of the exposure device 60, movement of each end of the exposure device 60 differs from one another. More specifically, one end of the exposure device 60 without the moving device 100 follows after the other end with the moving device 100. Providing the moving device 100 to both ends of the exposure device 60 as in the present illustrative embodiment can reduce the difference in the movement of the ends of the exposure device 60.

As illustrated in FIG. 3, a moving-device connector 107 connects the moving devices 100 provided at both ends of the exposure device 60. More specifically, the moving-device connector 107 connects the second link member 102 of the moving device 100 at one end to the second link member 102 at the other end.

Without the moving-device connector 107 connecting the moving devices 100, if there is a delay in movement of the moving devices 100 at each end, the exposure device 60 gets deformed when the exposure device 60 is moved. When the exposure device 60 is moved and deformed, the projection 62 contacts the second opening or slot 105*b* so that the projection 62 does not move smoothly in the second opening or slot 105*b*. As a result, the exposure device 60 does not move smoothly.

By contrast, according to the present illustrative embodiment, the moving devices 100 at each end are connected by the moving-device connector 107, thereby moving integrally both moving devices 100. With this configuration, deformation of the exposure device 60 is prevented, hence moving the exposure device 60 smoothly.

Upon installation of the process cartridge 50, the process cartridge 50 may contact and damage the exposure device 60 at the second, or retracted, position. When the cover 91 is opened, users may accidentally touch the exposure device 60 and damage the device. To protect the exposure device 60, the exposure device 60 at the second position is provided with a protective member 112 as illustrated in FIG. 4. The protective member 112 extends in the longitudinal direction of the exposure device 60. One end of the protective member 112 is fixed to the lateral plate of the frame at one end. The other end of the protective member 112 is fixed to the lateral plate of the frame at the other end. As illustrated in FIG. 4, the protective member 112 is substantially L-shaped in cross-section and includes a first plane 112*a* and a second plane 112*b*. The first plane 112*a* faces the surface of the exposure device 60 at the cover 91 side when the exposure device 60 is at the second position. The second plane 112*b* is disposed between the exposure device 60 at the second position and an area in which the process cartridge 50 is pulled out. In this configuration, the second plane 112*b* serves as a separator.

Figure 11:
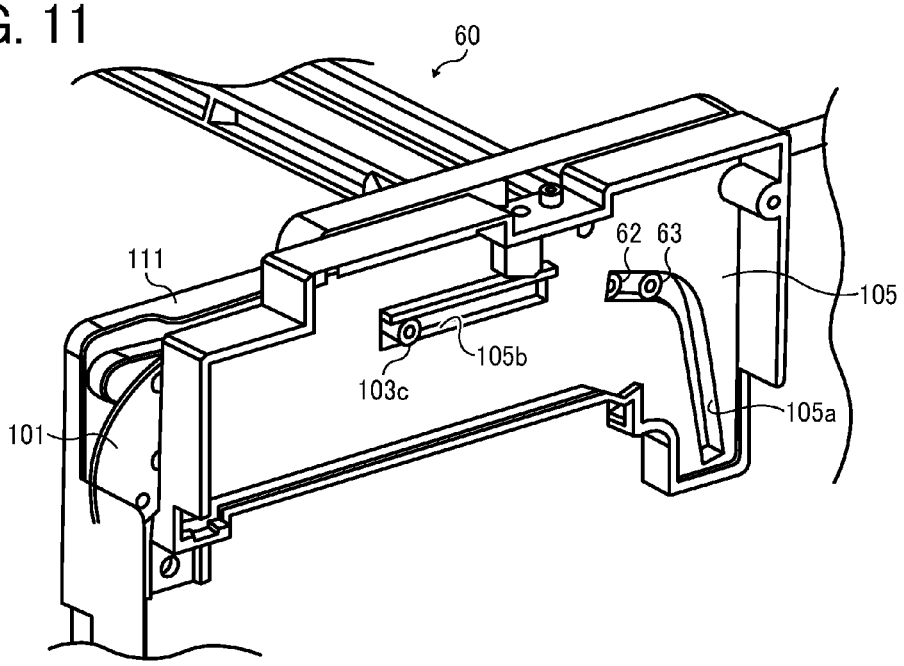
FIG. 11 is a perspective view schematically illustrating a cover.

Alternatively, as illustrated in FIG. 11, the first link member 101, the first arm 103*a*, and the second arm 103*b* may be covered with a cover 105 and a lateral plate 111 of the frame of the image forming apparatus. FIG. 11 is a perspective view schematically illustrating the exposure device 60 and the cover 105 at one end of the exposure device 60. In FIG. 11, the cover 105 includes the first opening 105*a* and the second opening 105*b*. The connecting shaft 103*c* penetrates through the first opening 105*a*, thereby guiding the connecting shaft 103*c*. The projection 62 penetrates through the second opening 105*b*, thereby guiding the projection 62.

When the cover 91 is opened, the cover 105 and the lateral plate 111 protect the first link member 101, the first arm 103*a*, and the second arm 103*b* from inadvertent contact by users. With this configuration, the exposure device 60 is not easily moved from the second position (i.e., retracted position) to the first position (i.e., the engaged position) by the users. Upon installation of the process cartridge 50, the exposure device 60 at the second position is prevented from coming into contact with the process cartridge 50.

Figure 5:
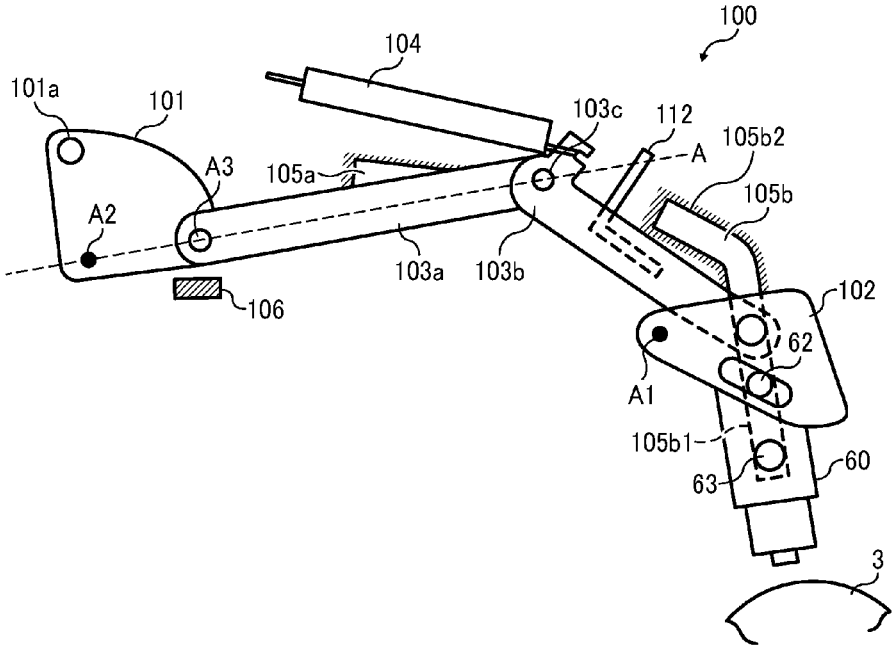
FIG. 5 is a schematic diagram illustrating the moving device while moving the exposure device from a engaged position (first position) to a retracted position (second position)
Figure 6:
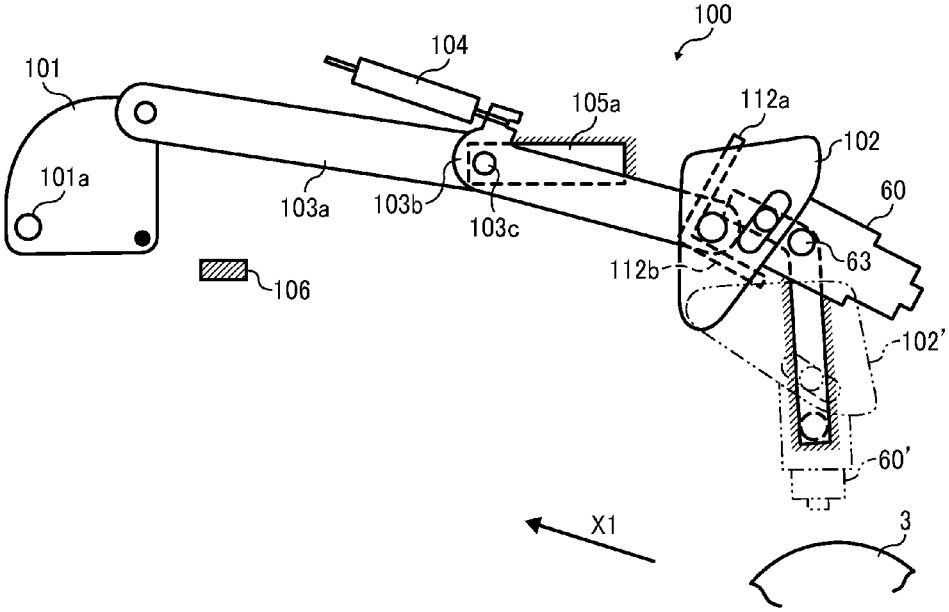
FIG. 6 is a schematic diagram illustrating the moving device at the retracted position.

Next, with reference to FIGS. 5 through 7D, a description is provided of movement of the exposure device 60 between the first position at which the exposure device 60 forms a latent image and the second position at which the exposure device 60 is retracted from the photosensitive drum 3. FIG. 5 is a schematic diagram illustrating the moving device 100 while moving the exposure device 60 from the first position (engaged position) to the second position (retracted position). FIG. 6 is a schematic diagram illustrating the moving device 100 when the exposure device 60 is at the second position. FIGS. 7A through 7D are schematic diagrams showing positional relations of the first link member 101 of the moving device 100 and the cover 91 when moving the exposure device 60 from the first position to the second position.

As illustrated in FIGS. 7A through 7D, the cover 91 includes a lever 91*a* serving as an interlocking member, and a guide member 91*b*. The lever 91*a* is hook-shaped and hooked to the boss 101*a* of the first link member 101. The guide member 91*b* guides the boss 101*a*.

Figure 7A:
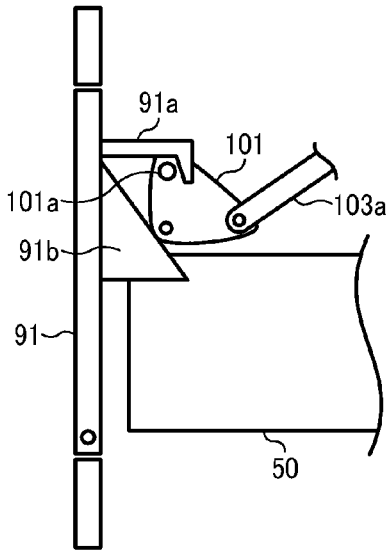
FIGS. 7A through 7D are schematic diagrams showing positional relations of a first link member of the moving device and a cover of the image forming apparatus when moving the exposure device from the engaged position to the retracted position.

As illustrated in FIG. 7A, when the cover 91 is closed and the exposure device 60 is at the first position, the lever 91*a* is separated from the boss 101*a*.

Deformation of the cover 91 and parts variations due to high temperature or the like, the lever 91*a* may deviate from a normal position, towards an opening direction of the cover 91, that is, towards the left in FIG. 7A. From state shown in FIG. 7A, when the lever 91*a* contacts the boss 101*a* and the lever 91*a* shifts from the normal position towards the left in FIG. 7A, the force of the lever 91*a* acts on the first link member 101, thereby rotatably moving the first link member 101 in the counterclockwise direction. As a result, the exposure device 60 is moved undesirably via the moving device 100, changing the position of the exposure device 60 relative to the photosensitive drum 3. Furthermore, vibration of the lever 91*a* caused by external stress on the cover 91 causes the exposure device 60 to vibrate via the moving device 100, thereby degrading the quality of the latent image.

According to the present illustrative embodiment, when the exposure device 60 is at the first position, the lever 91*a* is separated from the boss 101*a*, that is, the lever 91*a* which is an action member and the first link member 101 which is a rotary member are not in contact with one another. In this configuration, no force acts between the cover 91 and the first link member 101. Even when the cover 91 deforms under a high-temperature environment, causing the lever 91*a* to deviate from the normal position towards the opening direction of the cover 91 to some extent, the lever 91*a* prevents the first link member 101 from rotatably moving. With this configuration, the exposure device 60 is positioned in place relative to the photosensitive drum 3, as opposed to the configuration in which the lever 91*a* contacts the boss 101*a*. Furthermore, it is advantageous in that even when the cover 91 vibrates, the moving device 100 is isolated from vibration of the cover 91, thereby preventing the exposure device 60 from vibrating.

According to the present illustrative embodiment, when the exposure device 60 is at the first position, the first link member 101 is biased by the tension spring 104 in the opposite direction of the direction when moving the exposure device 60 from the first direction to the second direction. With this configuration, it is not necessary to move the restriction member 106 when the first link member 101 is rotated to move the exposure device 60 from the first position to the second position. Thus, the restriction member 106 can be fixed to the frame of the image forming apparatus 1. The restriction member 106 is positioned in place relative to the frame, as opposed to the configuration in which the restriction member 106 moves relative to the frame. Accordingly, the exposure device 60 reliably contacts the positioning member 24 (shown in FIG. 2), hence positioning the exposure device 60 at the first position with precision.

As the cover 91 is being opened, the lever 91*a* contacts the boss 101*a*, rotating the first link member 101 in the counterclockwise direction. In this state, the first link member 101 is biased in the opposite direction of the direction (counterclockwise direction in FIG. 7B) when moving the exposure device 60 to the second direction by the tension spring 104 via the connector 103. The first link member 101 is rotated against the force of the tension spring 104.

Figure 7B:
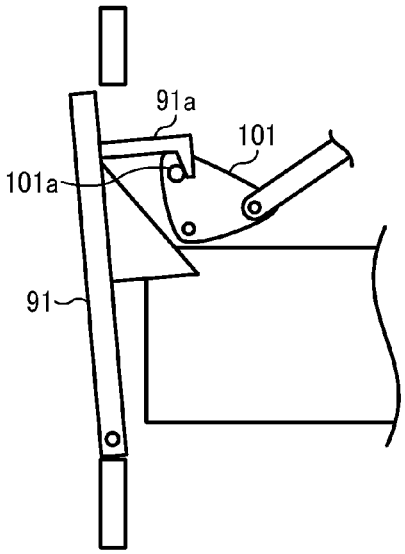

After the first link member 101 is rotated to the position shown in FIG. 7B against the force of the tension spring 104, as illustrated in FIG. 5, the support position A3 of the first link member 101 is brought on the line A connecting the fulcrum A2 of the first link member 101 and the connecting shaft 103*c*. By the time the support position A3 comes to the line A, the connecting shaft 103*c* moves away from the first link member 101 and the holder 65 of the exposure device 60 compresses the spring 66 to move closer to the photosensitive drum 3 from the first position shown in FIG. 2. Alternatively, by the time the support position A3 comes to the line A, the connecting shaft 103*c* moves away from the first link member 101 and the second arm 103*b* may rotate about the supporting point of the second link member 102. In a case in which the exposure device 60 is positioned at the first position only when the first link member 101 contacts the restriction member 106 (that is, in the configuration without the positioning member 24 of the process cartridge 50), the exposure device 60 may be moved closer to the photosensitive drum 3 after the connecting shaft 103*c* moves away from the first link member 101 before the support position A3 comes to the line A.

Figure 7C:
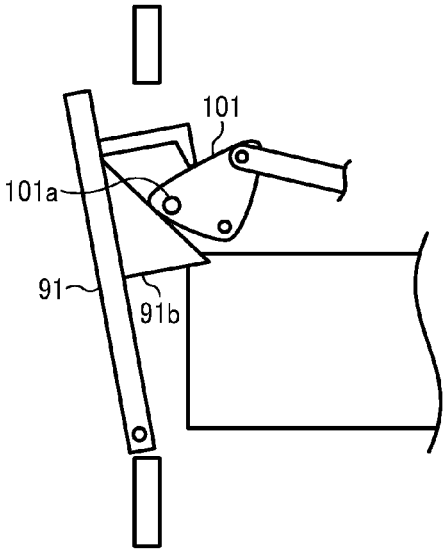

As the support position A3 comes to the line A and the lever 91*a* moves the first link member 101 further in the counterclockwise direction, the support position A3 moves up beyond the line A shown in FIG. 5 and the tension of the tension spring 104 that moves the connecting shaft 103*c* towards the first link member 101 (left side in FIG. 5) generates a force that causes the support position A3 to move to the opposite direction of the direction T1 shown in FIG. 4. As a result, the first link member 101 is biased by the tension spring 104 via the connector 103 in the direction (counterclockwise direction in FIG. 5) for moving the exposure device 60 to the second position. Accordingly, the first link member 101 is rotated by the force of the tension spring 104 in the counterclockwise direction which is the direction for moving the exposure device 60 to the second direction. Subsequently, as illustrated in FIG. 7C, the boss 101*a* separates from the lever 91*a* and contacts the guide member 91*b*.

Due to the rotation of the first link member 101 in the counterclockwise direction, the connecting shaft 103*c* is guided to the first opening or slot 105*a* and then to the cover 91 (to the left in FIG. 5). Then, the second arm 103*b* moves towards the cover 91 (to the left in FIG. 5), causing the second link member 102 to rotate about the fulcrum A1 in the counterclockwise direction. The projection 62 penetrating through the slot 102*a* of the second link member 102 and the guide projection 63 of the exposure device 60 are guided upward in the second opening or slot 105*b* away from the photosensitive drum 3.

The slot 102*a* of the second link member 102 in which the projection 62 is supported is an elongate hole extending to the fulcrum A1 side. With this configuration, the exposure device 60 does not move radially but is guided linearly by the second opening or slot 105*b* from the first position to the second position along the direction of the normal vector of the photosensitive drum 3.

Because the exposure device 60 moves linearly from the first position to the second position along the direction of the normal vector of the photosensitive drum 3, the charging roller 4 and the developing device 2 disposed near the exposure device 60 do not hinder movement of the exposure device 60 from the first position to the second position, which allows downsizing of the image forming apparatus as a whole.

Figure 7D:
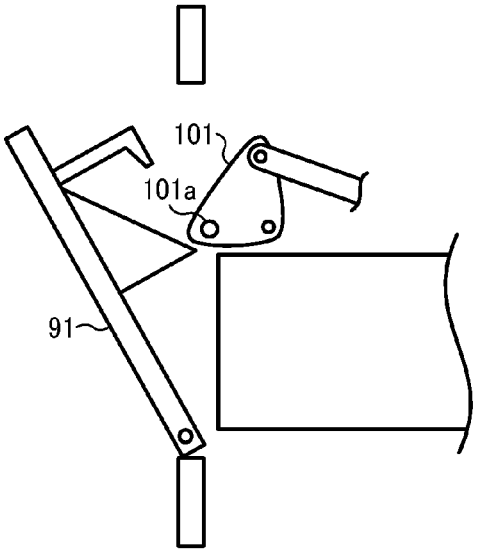

As the cover 91 is opened further from the state shown in FIG. 7C, the first link member 101 is rotated in the counterclockwise direction due to the force of the tension spring 104 while the boss 101*a* is guided by the guide member 91*b*, thereby moving the exposure device 60 to the second position. As illustrated in FIG. 7D, as the boss 101*a* separates from the guide member 91*b*, the moving device 100 comes to the position shown in FIG. 6 and the exposure device 60 arrives at the second position.

As illustrated in FIG. 6, the second opening or slot 105*b* includes a portion 105*b*1 that extends substantially linearly in the direction of the normal vector of the photosensitive drum 3 and a portion 105*b*2 that extends parallel to a direction X1 in which the process cartridge 50 is taken out. In this configuration, the exposure device 60 moves linearly along the direction of normal vector of the photosensitive drum 3 to some extent. When the projection 62 comes to the portion 105*b*2 of the opening or slot 105*b* parallel to the direction X1, the exposure device 60 rotates about the guide projection 63 in the counterclockwise direction, changing its orientation. Subsequently, as the guide projection 63 arrives at the portion 105*b*2, the exposure device 60 is positioned parallel to the direction X1 in which the process cartridge 50 is pulled out.

According to the present illustrative embodiment, after moving the exposure device 60 linearly along the direction of the normal vector of the photosensitive drum 3, the exposure device 60 is rotated so as to be positioned parallel to the direction X1 in which the process cartridge is pulled out. With this configuration, the vertical (up and down) movement of the exposure device 60 moving to the second position at which the exposure device 60 does not interfere with installation and detachment of the process cartridge 50 is less than when the exposure device 60 is not rotated. Therefore, the vertical space in which the exposure device 60 moves between the first position and the second position can be reduced, allowing downsizing of the image forming apparatus.

As illustrated in FIG. 6, when the exposure device 60 comes to the second position, the first plane 112*a* of the protective member 112 separates the space between the exposure device 60 and an opening of the frame opened by the cover 91. Furthermore, the second plane 112*b* of the protective member 112 separates between the exposure device 60 and the area at which the process cartridge 50 is moved. With this configuration, even when the process cartridge 50 accidentally moves towards the exposure device 60 while the process cartridge 50 is being installed in the frame from the opening, the process cartridge 50 comes into contact with the protective member 112, thereby preventing the process cartridge 50 from contacting the exposure device 60. Furthermore, the exposure device 60 is prevented from getting touched by users, hence preventing damage.

As the exposure device 60 arrives at the second position, the connecting shaft 103*c* contacts the first opening or slot 105*a* at the lateral end side of the cover 91 (left end portion in FIG. 6), thereby stopping rotation of the first link member 101. Alternatively, rotation of the first link member 101 may be stopped as the exposure device 60 arrives at the second position and the tension spring 104 obtains its free length.

According to the present illustrative embodiment, the exposure device 60 moves from the first position to the second position when the cover 91 is opened so that the exposure device 60 does not interfere with replacement of the process cartridge 50. The process cartridge 50 can be easily removed and installed from the opening of the frame (i.e., the opening which is opened by the cover 91).

According to the present illustrative embodiment, as the first link member 101 is rotated in the counterclockwise direction from the state shown in FIG. 5, the tension of the tension spring 104 changes the direction of rotation of the first link member 101. In this configuration, when the exposure device 60 is at the second position, the first link member 101 is biased in the direction for moving the exposure device 60 from the first position to the second position. Accordingly, even when the exposure device 60 is at the second position and the image forming apparatus 1 vibrates and/or the process cartridge 50 contacts the first link member 101 upon removal of process cartridge 50, causing the first link member 101 to rotate in the clockwise direction (in the direction for moving the exposure device 60 from the second position to the first position), the force of the tension spring 104 which causes the first link member 101 to rotate in the counterclockwise direction acts on the first link member 101, thereby preventing the exposure device 60 from moving from the second position to the first position. With this configuration, the exposure device 60 is prevented from moving unexpectedly from the second position to the first position while the cover 91 is opened.

After the process cartridge 50 is replaced and as the cover 91 is being closed, the guide member 91*b* of the cover 91 contacts the boss 101*a* of the first link member 101. As the cover 91 is further closed, the boss 101*a* is guided by the guide member 91*b* and the first link member 101 rotates in the clockwise direction in FIG. 7 against the force exerted by the tension spring 104. Accordingly, the exposure device 60 moves from the second position to the first position. As the boss 101*a* is pressed by the guide member 91*b* and the first link member 101 is rotated in the clockwise direction further from the state shown in FIG. 5, the support position A3 moves below the line A, and the direction of movement of the first link member 101 due to the force of the tension spring 104 changes. Subsequently, the first link member 101 is rotated due to the tension of the tension spring 104 and contacts the restriction member 106.

Rotation of the first link member 101 in the clockwise direction in FIG. 7 causes the exposure device 60 to move from the second position to the first position. When the exposure device 60 moves to the vicinity of the first position, the exposure device 60 is guided to the positioning member 24 of the process cartridge 50 by the guide member 23 of the process cartridge 50 as illustrated in FIG. 2. As the exposure device 60 contacts the positioning member 24, the exposure device 60 is positioned at the first position.

As described above, when the exposure device 60 moves between the first position and the second position, the direction of movement of the first link member 101 due to the tension of the tension spring 104 changes in the moving device 100. In this configuration, when the exposure device 60 is at the first position, the first link member 101 is biased by the tension spring 104 in the direction for moving the exposure device 60 from the second position to the first position. As described above, it is not necessary to retract the restriction member 106 for stopping rotation of the first link member 101 when the exposure device 60 moves from the first position to the second position. Thus, the restriction member 106 can be fixed to the frame, which allows the exposure device 60 to be positioned at the first position with precision.

In a case in which the exposure device 60 is at the second position, the exposure device 60 can be biased by the tension spring 104 in the direction for moving the exposure device 60 from the first position to the second position. Accordingly, upon replacement of the process cartridge 50, the exposure device 60 is prevented from moving from the second position to the first position, and hence preventing the exposure device 60 from coming into contact with the process cartridge 50 and getting damaged.

According to the present illustrative embodiment, the connector 103 is includes a plurality of connecting members. In a case in which the connector 103 is formed of a single connecting part, the amount of rotation of the second link member 102 coincides with the amount of rotation of the first link member 101. As a result, the amount of movement of the exposure device 60 from the first position to the second position increases, which necessitates a relatively large space for the exposure device 60 to move from the first position to the second position. By contrast, by constituting the connector 103 with a plurality of connecting parts and by rotating these connecting parts about connecting portions thereof, the amount of rotation of the second link member 102 can be made less than the amount of rotation of the first link member 101. Accordingly, the space in which the exposure device 60 moves is reduced as compared with constituting the connector with a single part.

Preferably, the cover 91 is provided to the front side or the proximal side of the image forming apparatus. Providing the cover 91 to the front side of the image forming apparatus facilitates replacement of the process cartridge 50.

Constituting the connector 103 with the plurality of connecting parts can provide flexible retraction paths for the exposure device 60. In this configuration, even when the second link member 102 is not rotatably supported by the frame but is supported only by the connector 103, the exposure device 60 can be pulled out linearly in the direction of the normal vector of the photosensitive drum 3. More specifically, the second opening or slot 105*b* is a linearly extended hole in the direction of the normal vector of the photosensitive drum 3, thereby allowing the second arm 103*b* holding the second link member 102 to move linearly in the direction of the normal vector of the photosensitive drum 3. Accordingly, the exposure device 60 held by the second link member 102 moves linearly in the direction of the normal vector of the photosensitive drum 3.

The number of connecting parts constituting the connector 103 is not limited to two. However, if the number of the connecting parts is too many, the space for installation of the connecting parts increases. Thus, preferably, the number of connecting parts of the connector 103 is two as in the present illustrative embodiment.

Providing the tension spring 104 to the connector 103 allows the tension spring 104 to be disposed in the same space in which the connector 103 including the first arm 103*a*, the second arm 103*b*, and the connecting shaft 103*c* moves, thereby downsizing the image forming apparatus 1.

Figure 8:
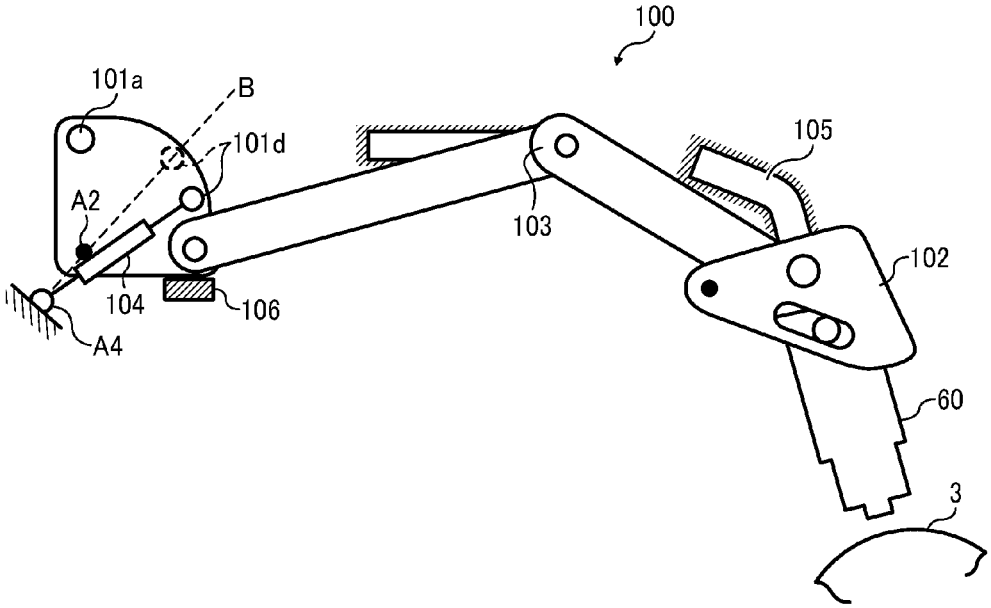
FIG. 8 is a schematic diagram illustrating a variation of the moving device.
Figure 9:
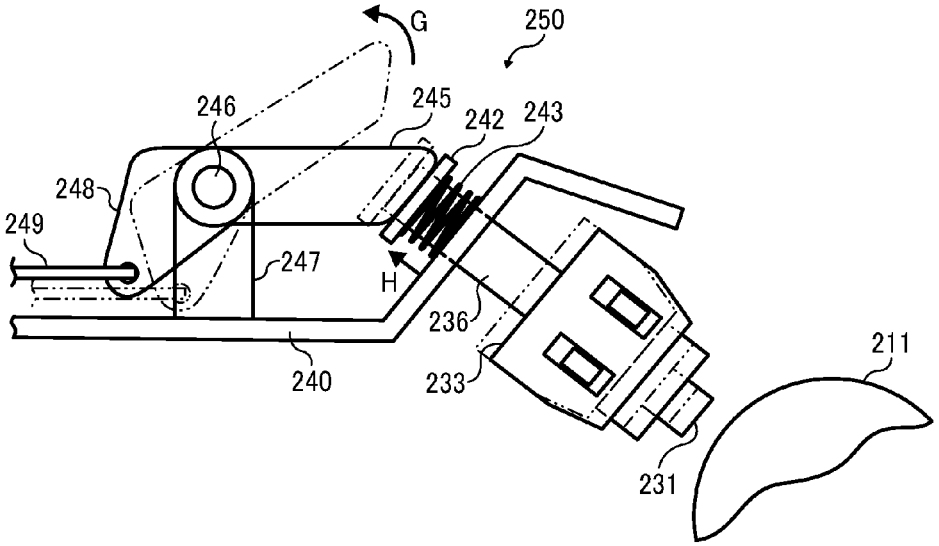
FIG. 9 RELATED ART
FIG. 9 is a schematic diagram illustrating a related-art moving device and a writing head.
Figure 10:
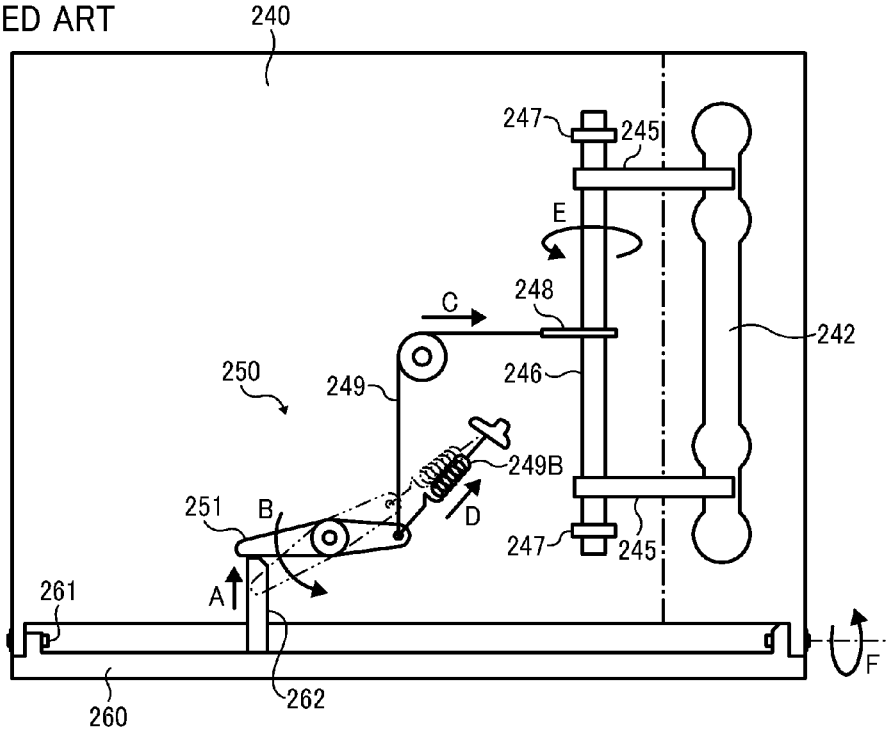
FIG. 10 RELATED ART
FIG. 10 is a top view schematically illustrating the related-art moving device of FIG. 9.

In the present illustrative embodiment, the first link member 101 is biased by the tension spring 104 via the connector 103. Alternatively, as illustrated in FIG. 8, the first link member 101 may include a hook 101*d* to which the tension spring 104 is hooked. In other words, the tension spring 104 is directly attached to the first link member 101 and biases the first link member 101. More specifically, as illustrated in FIG. 8, when the hook 101*d* is at the left side of a broken line B which is a line between a support point A4 of the tension spring 104 and the fulcrum A2 of the first link member 101, the direction of rotation of the first link member 101 biased by the tension spring 104 changes from the clockwise direction to the counterclockwise direction, that is, from the direction for moving the exposure device 60 to the first position to the direction for moving the exposure device 60 to the second position.

According to the present illustrative embodiment, the exposure device 60 is held by the first link member 101 via the connector 103. Alternatively, the exposure device 60 may be held directly by the first link member 101.

In the present illustrative embodiment shown in FIGS. 7A through 7D, the cover 91 includes the lever 91*a* hooked to the boss 101*a* of the first link member 101 to rotate the first link member 101 in the counterclockwise direction against the tension of the tension spring 104 and the guide member 91*b* to guide the boss 101*a* to rotate the first link member 101 in the clockwise direction against the tension of the tension spring 104. Alternatively, the first link member 101 may be rotated in both directions using only the lever 91*a* as illustrated in FIG. 12.

Figure 12:
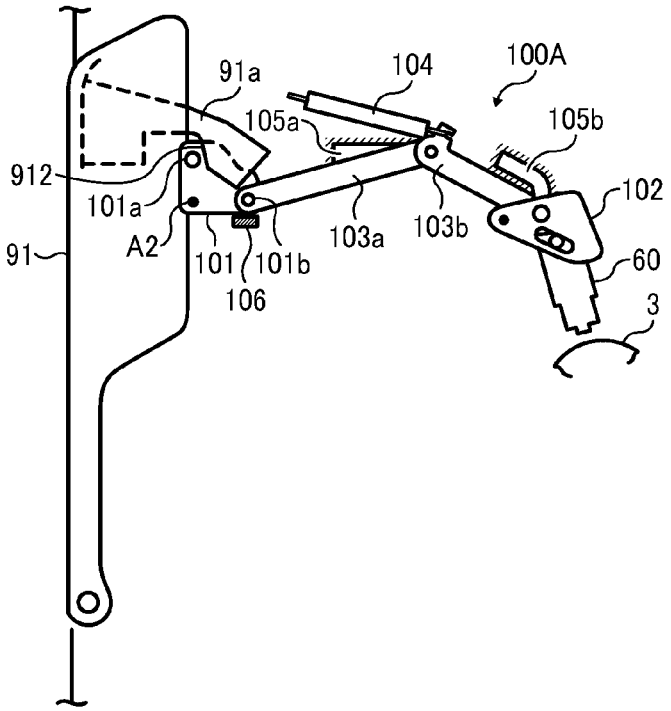
FIG. 12 is a schematic diagram illustrating a variation of the moving device.

With reference to FIGS. 12 through 15, a description is provided of a variation of the moving device 100. As illustrated in FIG. 12, in a moving device 100A, as the cover 91 is closed, the lever 91*a* pushes an attachment member 101*b* serving as a second contact portion by which the first arm 103*a* is attached to the first link member 101, thereby rotating the first link member 101 in the clockwise direction in FIG. 12.

Figure 13:
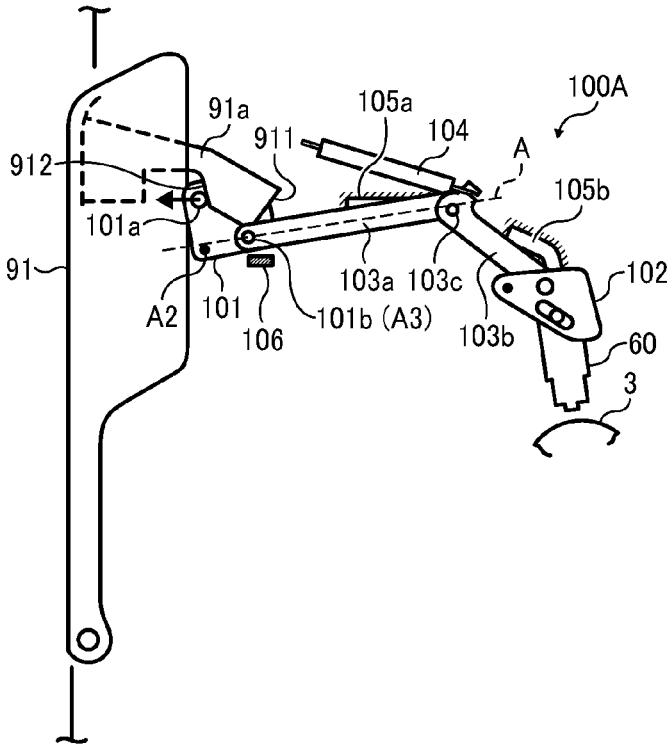
FIG. 13 is a schematic diagram illustrating the moving device of FIG. 12 while moving the exposure device from the engaged position to the retracted position.
Figure 14:
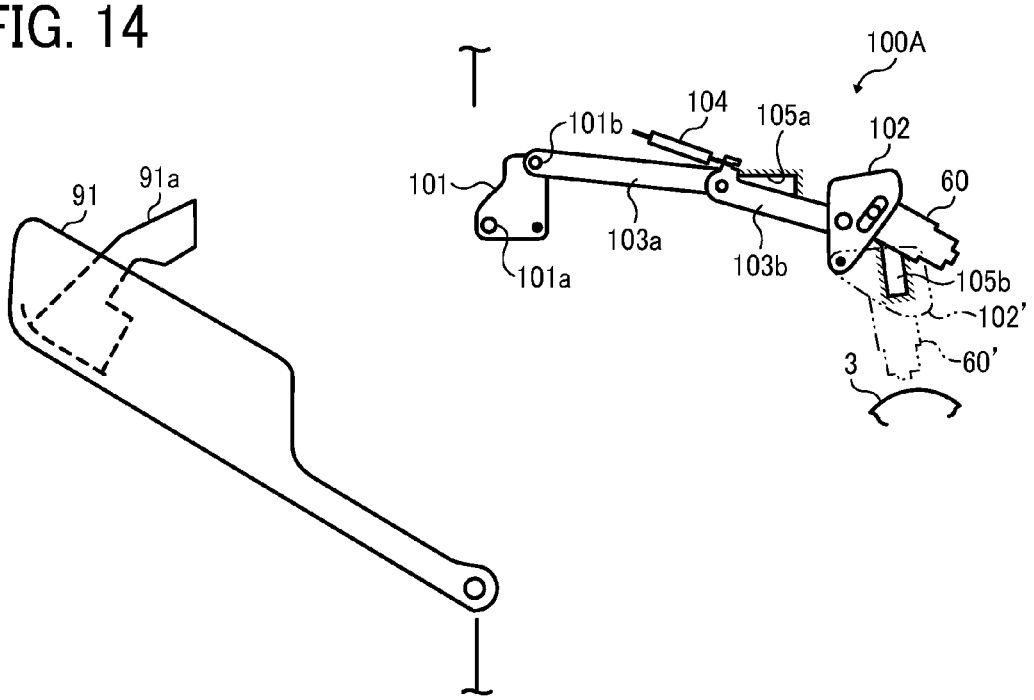
FIG. 14 is a schematic diagram illustrating the moving device of FIG. 12 at the retracted position.
Figure 15:
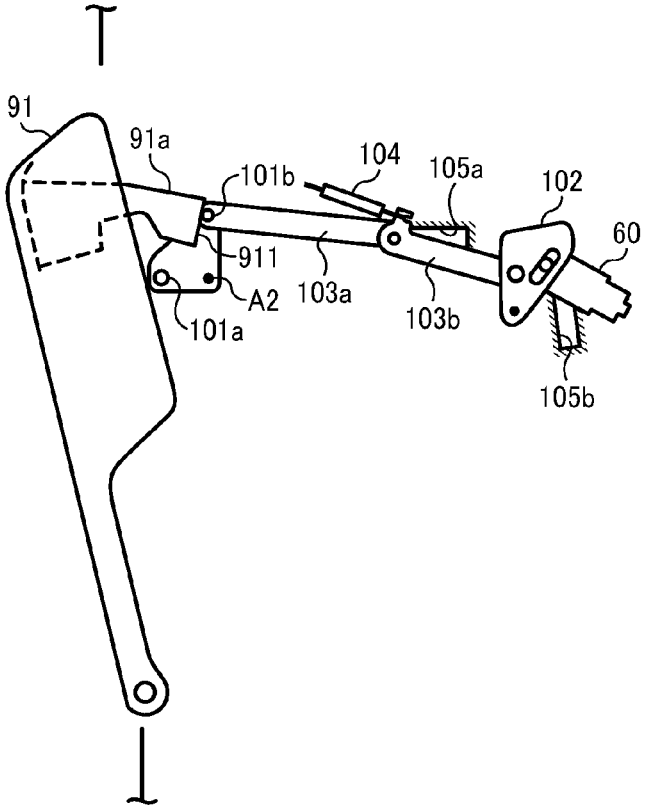
FIG. 15 is a schematic diagram illustrating the moving device of FIG. 12 while moving the exposure device from the retracted position to the engaged position.

FIG. 13 illustrates positional relations of the moving device 100A and the cover 91 when moving the exposure device 60 from the first position to the second position. FIG. 14 illustrates positional relations of the moving device 100A and the cover 91 when the exposure device 60 is at the second position. FIG. 15 illustrates positional relations of the moving device 100A and the cover 91 when moving the exposure device 60 from the second position to the first position.

As illustrated in FIGS. 13 and 14, when moving the exposure device 60 from the first position to the second position, similar to the foregoing embodiments, as the cover 91 is opened, the lever 91*a* comes into contact with the boss 101*a* serving as a first contact portion and moves the first link member 101 in the counterclockwise direction until the support position A3 of the first arm 103*a* comes to the line A connecting the fulcrum A2 of the first link member 101 and the connecting shaft 103*c*. In a state in which the support position A3 (the attachment member 101*b*) is on the line A, the lever 91*a* moves the first link member 101 further in the counterclockwise direction, thereby moving the support position A3 above the line A shown in FIG. 13. As a result, the first link member 101 rotates automatically in the counterclockwise direction due to the tension of the tension spring 104, moving the exposure device 60 to the second position.

After the process cartridge 50 is replaced and as the cover 91 is being closed, as illustrated in FIG. 15, a leading end surface 911 of the lever 91*a* contacts the attachment member 101*b* serving as the second contact member.

As the cover 91 is further closed from the state shown in FIG. 15, the lever 91*a* pushes the attachment member 101*b*, thereby rotating the first link member 101 in the clockwise direction against the tension of the tension spring 104. Then, the leading end surface 911 of the lever 91*a* pushes the attachment member 101*b* to the position shown in FIG. 13, thereby rotating the first link member 101 in the clockwise direction against the tension of the tension spring 104.

In this variation, shapes of the first link member 101 and the lever 91*a* are formed such that the leading end surface 911 of the lever 91*a* pushes the attachment member 101*b* to the position shown in FIG. 13. More specifically, in order to make the attachment member 101*b* to contact an upper portion of the leading end surface 911 of the lever 91*a* as illustrated in FIG. 15, the distance between the fulcrum A2 of the first link member 101 and the attachment member 101*b* is longer than the distance between the fulcrum A2 and the boss 101*a*. Furthermore, the lever 91*a* includes an inwardly-curved portion 912 which hooks the boss 101*a*, and the lever 91*a* projects from the curved portion 912 by a certain distance such that the leading end surface 911 of the lever 91*a* pushes the attachment member 101*b* to the position shown in FIG. 13.

As the leading end surface 911 of the lever 91*a* pushes further the attachment member 101*b* from the position shown in FIG. 13, the direction of rotation of the first link member 101 moved by the tension spring 104 changes. The first link member 101 is rotated by the tension of the tension spring 104 and contacts the restriction member 106.

In the moving device 100A of the present variation, the first link member 101 is rotated only by the lever 91*a* until the direction of rotation of the first link member 101 by the tension spring 104 changes. With this configuration, the first link member 101 is moved with a simple configuration, as compared with moving the first link member 101 using the lever 91*a* and the guide member 91*b*. The number of parts is reduced, hence reducing the cost and space.

Although the embodiment of the present invention has been described above, the present invention is not limited to the foregoing embodiments, but a variety of modifications can be made within the scope of the present invention.

According to an aspect of the disclosure, a moving device (e.g., the moving device 100) for moving a latent image forming device (e.g., the exposure device 60) employed in an image forming apparatus, between a first position at which the latent image forming device forms a latent image on a surface of a latent image bearing member (e.g., the photosensitive drum 3) and a second position at which the latent image forming device is separated from the latent image bearing member, includes a rotary member (e.g., the first link member 101) rotatably held by a frame of the image forming apparatus, to rotatably move to move the latent image forming device between the first position and the second position; a biasing member (e.g., the tension spring 104) to bias the rotary member; and a restriction member (e.g., the restriction member 106) to restrict rotation of the rotary member rotated by a force of the urging member as the latent image forming device is at the first position. The direction of the force of the urging member is changed from a stopping direction in which rotation of the rotary member is stopped to a direction opposite to the stopping direction while the rotary member is rotated to move the latent image forming device from the second position to the first position.

With this configuration, the latent image forming device is positioned accurately at the first position, the engaged position. Furthermore, even when the latent image forming device is at the second position and the image forming apparatus vibrates due to some stress applied thereto, the latent image forming device does not easily move from the second position to the first position.

According to an aspect of the disclosure, the moving device includes an interlocking member (e.g., the lever 91*a*) to move in sync with movement of a cover (e.g., the cover 91) that covers an opening of the frame. The interlocking member causes the rotary member to rotate. When the cover is closed, the interlocking member and the rotary member are not in contact with each other. With this configuration, misalignment of the exposure device 60 or the latent image forming device relative to the latent image bearing member is prevented. Vibration of the latent image forming device is also prevented.

According to an aspect of the disclosure, the rotary member includes a first contact portion (e.g., the boss 101*a*) that the interlocking member contacts as the cover is opened so as to rotate the rotary member in a first direction in which the latent image forming device is moved from the first position to the second position; and a second contact portion (e.g., the attachment member 101*b*) that the interlocking member contacts as the cover is closed so as to rotate the rotary member in an opposite direction of the first rotation direction. With this configuration, the rotary member (the first link member 101) can be moved with a simple configuration, as compared with moving the rotary member using the lever 91*a* and the guide member 91*b*.

According to an aspect of the disclosure, the restriction member is fixed to the frame of the image forming apparatus. With this configuration, the latent image forming device is positioned accurately at the first position as compared with a configuration in which the restriction device is movable relative to the image forming apparatus.

According to an aspect of the disclosure, the moving device includes a holder (e.g., the second link member 102) to hold the latent image forming device such as the exposure device 60, and a connector (e.g., the connector 103) to connect the holder and the rotary member. This configuration provides flexible retraction paths for the latent image forming device such as the exposure device 60. Furthermore, the latent image forming device can move linearly from the first position in the direction perpendicular to the surface of the latent image bearing member such as the photosensitive drum 3. With this configuration, the developing device 2 and the charging roller 4 can be disposed near the latent image forming device without hindering movement of the latent image forming device. Furthermore, movement of the latent image forming device is reduced, thereby reducing the space required for moving the latent image forming device and hence downsizing the image forming apparatus.

According to an aspect of the disclosure, the biasing member such as the tension spring 104 is attached to the connector such as the connector 103. With this configuration, as described above, the biasing member can be disposed within the space for moving the connector 103, hence downsizing the image forming apparatus.

According to an aspect of the disclosure, the holder such as the second link member 102 is rotatably supported by the frame of the image forming apparatus, and the holder movably holds the latent image forming device such as the exposure device 60 such that the latent image forming device is movable towards a center of rotation of the holder. With this configuration, as described above, when the latent image forming device is moved from the first position, the latent image forming device is moved linearly in the direction of the normal vector of the latent image bearing member, thereby allowing the developing device 2 and the charging roller to be disposed near the latent image forming device. The size of the image forming apparatus can be reduced.

According to an aspect of the disclosure, the connector comprises a plurality of connecting members (e.g., the connecting members 103*a*, 103*b*). Constituting the connector 103 with the plurality of connecting parts can provide flexible retraction paths for the latent image forming device such as the exposure device 60.

According to an aspect of the disclosure, the moving device includes a connector guide member (e.g., the second opening or slot 105*b*) to guide linearly an end of the connecting member such as the second arm 103*b* to which the holder is attached. With this configuration, as described above, the latent image forming device such as the exposure device 60 can be moved linearly in the direction of the normal vector relative to the surface of the latent image bearing member, thereby allowing the developing device 2 and the charging roller 4 to be disposed near the latent image forming device. The size of the image forming apparatus can be reduced.

According to an aspect of the disclosure, the moving device includes a cover (e.g., the cover 105) to cover the rotary member and the connecting members of the connector. With this configuration, as described above, the rotary member (e.g., first link member 101) and the plurality of the connecting members are prevented from getting touched by users. Furthermore, the exposure device 60 is prevented from moving unexpectedly from the second position to the first position. Upon installation of the process cartridge, the latent image forming device at the first position is prevented from coming into contact with the process cartridge 50. The moving device includes a guide member to guide the latent image forming device to the first position. With this configuration, the latent image forming device is positioned accurately at the first position.

According to an aspect of the disclosure, the guide member guides the latent image bearing member which comes near the first position, thereby achieving cost reduction.

According to an aspect of the disclosure, when the latent image forming device is at the second position, the latent image forming device is held substantially parallel to a direction of removal of the latent image forming device from the opening of the cover. With this configuration, the space in which the latent image forming device moves from the first position to the second position can be reduced, allowing downsizing of the image forming apparatus.

According to an aspect of the disclosure, the moving device includes a protective member (e.g., the protective member 112) to protect the latent image forming device at the second position. With this configuration, the latent image forming device is prevented from getting damaged.

According to an aspect of the disclosure, an image forming apparatus includes a latent image bearing member to bear a latent image on a surface thereof; a latent image forming device to form the latent image on the surface of the latent image bearing member; and the moving device described above. With this configuration, an optimum latent image is produced, thus producing a high-quality image.

According to an aspect of the disclosure, the image forming apparatus includes a plurality of the moving devices. The moving device is disposed at both ends of the latent image forming device. Providing the moving device to both ends of the latent image forming device can reduce deviation in the movement of the latent image forming device.

According to an aspect of the disclosure, the image forming apparatus includes a moving-device connector (e.g., the moving-device connector 107) connecting the moving devices at both ends of the latent image forming device. With this configuration, the moving devices are connected by the moving-device connector, thereby moving integrally the moving devices.

According to an aspect of the disclosure, the image forming apparatus includes a frame including an opening; a cover (e.g., the cover 91) to open and close the opening; and a detachable housing (e.g. the process cartridge 50) to house at least the latent image bearing member (e.g., the photosensitive drum 3). The detachable housing is detachably attachable from the image forming apparatus from the opening of the frame. With this configuration, as described above, upon installation and removal of the detachable housing the latent image forming device does not interfere with the operation.

According to an aspect of the disclosure, the detachable housing includes a positioning member (e.g., the positioning member 24) to position the latent image forming device at the first position. With this configuration, the latent image forming device can be positioned in place relative to the latent image bearing member.

According to an aspect of the disclosure, the cover is provided to a front side of the image forming apparatus, which coincides with a proximal side thereof. Providing the cover to the front side of the image forming apparatus facilitates installation and replacement of the process cartridge.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A moving device for moving a latent image forming device employed in an image forming apparatus between a first position at which the latent image forming device forms a latent image on a surface of a latent image bearing member and a second position at which the latent image forming device is separated from the latent image bearing member, the moving device comprising:

a rotary member rotatably supported by a frame of the image forming apparatus to move the latent image forming device between the first position and the second position;

a biasing member to bias the rotary member;

a restriction member to restrict rotation of the rotary member biased by the biasing member in a state in which the latent image forming device is at the first position, a direction of the force of the biasing member being changed from a stopping direction in which rotation of the rotary member is stopped to a direction opposite to the stopping direction while the rotary member is rotated to move the latent image forming device from the second position to the first position; and an interlocking member to move in sync with movement of an openably closable cover that covers an opening in the frame to cause the rotary member to rotate, wherein, with the cover closed, the interlocking member and the rotary member are separated from each other.

2. The moving device according to claim 1, wherein the rotary member comprises:

a first contact portion that the interlocking member contacts as the cover is opened to rotate the rotary member in a first direction in which the latent image forming device is moved from the first position to the second position; and a second contact portion that the interlocking member contacts as the cover is closed to rotate the rotary member in a second direction opposite the first direction.

3. The moving device according to claim 1, wherein the restriction member is fixed to the frame of the image forming apparatus.

4. The moving device according to claim 1, further comprising:

a holder to hold the latent image forming device; and a connector to connect the holder and the rotary member.

5. The moving device according to claim 4, wherein the biasing member is attached to the connector.

6. The moving device according to claim 1, wherein the holder is rotatably supported by the frame of the image forming apparatus and movably supports the latent image forming device as the latent image forming device moves toward the center of rotation of the holder.

7. The moving device according to claim 1, wherein the connector comprises a plurality of connecting members.

8. The moving device according to claim 7, further comprising a connector guide member to guide linearly an end of the connecting member to which the holder is attached.

9. The moving device according to claim 7, further comprising a cover to cover the rotary member and the connecting members of the connector.

10. The moving device according to claim 1, further comprising a guide member to guide the latent image forming device to the first position.

11. The moving device according to claim 10, wherein the guide member guides the latent image bearing member as the latent image bearing member approaches the first position.

12. The moving device according to claim 1, wherein, in a state in which the latent image forming device is at the second position, the latent image forming device is held substantially parallel to a direction of removal of the latent image bearing member from the opening in the frame covered by the cover.

13. The moving device according to claim 1, further comprising a protective member to protect the latent image forming device at the second position.

14. An image forming apparatus, comprising:

a latent image bearing member to bear a latent image on a surface thereof;

a latent image forming device to form the latent image on the surface of the latent image bearing member; and the moving device according to claim 1.

15. The image forming apparatus according to claim 14, wherein the moving device is disposed at both ends of the latent image forming device.

16. The image forming apparatus according to claim 15, further comprising a moving-device connector to connect the moving device at both ends of the latent image forming device.

17. The image forming apparatus according to claim 14, further comprising:

a frame having an opening therein;

a cover to cover the opening; and a detachable housing to house at least the latent image bearing member, the detachable housing being detachably attachable from the frame of the image forming apparatus at the opening in the frame of the image forming apparatus.

18. The image forming apparatus according to claim 17, wherein the detachable housing includes a positioning member to position the latent image forming device at the first position.

19. The image forming apparatus according to claim 17, wherein the cover is provided to a front side of the image forming apparatus.

20. A moving device for moving a latent image forming device employed in an image forming apparatus between a first position at which the latent image forming device forms a latent image on a surface of a latent image bearing member and a second position at which the latent image forming device is separated from the latent image bearing member, the moving device comprising:

a rotary member rotatably supported by a frame of the image forming apparatus to move the latent image forming device between the first position and the second position;

a biasing member to bias the rotary member; and a restriction member to restrict rotation of the rotary member biased by the biasing member in a state in which the latent image forming device is at the first position, a direction of the force of the biasing member being changed from a stopping direction in which rotation of the rotary member is stopped to a direction opposite to the stopping direction while the rotary member is rotated to move the latent image forming device from the second position to the first position, wherein the holder is rotatably supported by the frame of the image forming apparatus and movably supports the latent image forming device as the latent image forming device moves toward the center of rotation of the holder.

* * * * *